US009512602B2

(12) United States Patent
Lei

(10) Patent No.: US 9,512,602 B2
(45) Date of Patent: Dec. 6, 2016

(54) SINGLE PUSH BUTTON MULTI-FUNCTION WATER OUTPUT SWITCHING STRUCTURE

(71) Applicant: Xiamen Runner Industrial Corporation, Xiamen (CN)

(72) Inventor: Zheng-Zhen Lei, Xiamen (CN)

(73) Assignee: XIAMEN RUNNER INDUSTRIAL CORPORATION, Xiamen (CN)

( * ) Notice: Subject to any disclaimer, the term of this patent is extended or adjusted under 35 U.S.C. 154(b) by 6 days.

(21) Appl. No.: 14/750,240

(22) Filed: Jun. 25, 2015

(65) Prior Publication Data

US 2016/0024764 A1 Jan. 28, 2016

(30) Foreign Application Priority Data

Jul. 25, 2014 (CN) ..... 2014 2 0414168 U

(51) Int. Cl.
*F16K 11/14* (2006.01)
*E03C 1/08* (2006.01)
*E03C 1/04* (2006.01)

(52) U.S. Cl.
CPC ..... *E03C 1/08* (2013.01); *E03C 1/0405* (2013.01)

(58) Field of Classification Search
USPC ..... 137/620.2; 239/556, 562
See application file for complete search history.

(56) References Cited

U.S. PATENT DOCUMENTS 4,220,175 A * 9/1980 Keller, III ..... F16K 11/165 137/454.6
4,570,663 A * 2/1986 Gould ..... F16K 11/166 137/119.07
4,739,798 A * 4/1988 Botnick ..... F16K 11/22 137/599.03
5,048,759 A * 9/1991 Mazziotta ..... B05B 12/10 239/529
5,961,051 A * 10/1999 Matsui ..... B05B 1/1636 137/505
6,405,758 B1 * 6/2002 Hara ..... F16K 11/165 137/630.2
6,755,204 B2 * 6/2004 Herbert ..... F16K 11/166 137/1
6,918,902 B2 * 7/2005 French ..... A61M 1/0045 137/596.2
8,313,049 B2 * 11/2012 Xu ..... B05B 1/1618 239/280
8,800,893 B2 * 8/2014 Malek ..... B05B 1/1618 239/447
9,174,228 B2 * 11/2015 Bosio ..... B05B 1/1618

* cited by examiner

*Primary Examiner* — John Fox
(74) *Attorney, Agent, or Firm* — Chun-Ming Shih

(57) ABSTRACT

A single push button multi-function water output switching structure, comprising: an outer shell, and a water output panel, a seat body, and an inner sleeve disposed in the outer shell. Wherein, the seat body is provided with three through hole channels, while inside the three through hole channels are each provided with a set of water output guiding sleeve and a core plug. The water output panel is provided with three sets of independent water output channels, and a water output end surface of the water output guiding sleeve is provided with water output hole corresponding to and in communication with the water output channels. An inner sleeve is sleeved in a cavity in rear portion of the seat body. The switching structure is simple in structure, optimal in design, and is capable of achieving various different water outputs through pressing a single push button.

6 Claims, 6 Drawing Sheets

SINGLE PUSH BUTTON MULTI-FUNCTION WATER OUTPUT SWITCHING STRUCTURE

BACKGROUND OF THE INVENTION

Field of the Invention

The present invention relates to a water output switching structure, and in particular to a single push button multi-function water output switching structure.

The Prior Arts

In general, a water faucet is a valve for controlling the flow or stop of the output water, that is used daily and frequently by people in the locations of washing basin or bathing tub. However, presently, the water faucet has only one way of outputting water, yet that is not able to meet the demands of people requiring to use water output by various different ways. In this respect, some of the multi-function water output structures presently available on the market are not compact in construction, while its operation is quite complicated.

Therefore, presently, the design and performance of a water output switching structure is not quite satisfactory, and it has much room for improvement.

SUMMARY OF THE INVENTION

In view of the problems and drawbacks of the prior art, the present invention provides a single push button multi-function water output switching structure, to overcome the shortcomings of the prior art.

A major objective of the present invention is to provide a single push button multi-function water output switching structure, that is compact in structure, simple in operation, and is able to meet the demand of people requiring to use water output by various different ways.

The present invention provides a single push button multi-function water output switching structure, comprising: an outer shell; and a water output panel, a seat body, and an inner sleeve disposed in the outer shell. Wherein, the seat body is provided with three through hole channels, while inside the three through hole channels are each provided with a set of water output guiding sleeves and a core plug. The water output panel is provided with three sets of independent water output channels, and a water output end surface of the water output guiding sleeve is provided with water output hole corresponding to and in communication with the water output channels. An inner sleeve is sleeved in a cavity in a rear portion of the seat body, and in the inner sleeve is disposed in sequence a top rod pressing a top of a core plug, a top press spring, and a ratchet mechanism. On an end surface of a top rod is provided with a plurality of deep indent pits and a plurality of shallow indent pits, while a rear end of each core plug is acted against in the deep indent pit or the shallow indent pit. A compression spring is provided between a front end of the core plug and an indent cavity at a rear end of the water output guiding sleeve, a push button is each provided on the inner sleeve and the outer shell. A slant face at a lower end of the push button works in cooperation with a first slant face at a rear end of the ratchet mechanism, and on the top rod is provided with a protrusion button acting in cooperation with an inner wall button slot at a movable end of the ratchet mechanism.

According to an aspect of the present invention, on the core plug is provided with two seal rings, to work in tight seal cooperation with an inner wall of an indent cavity at a rear end of the water output guiding sleeves.

According to another aspect of the present invention, the top rod includes a top disk, and a column rod disposed at the rear end of the top disk, while a top press spring is sleeved around the column rod.

According to yet another aspect of the present invention, the ratchet mechanism includes a fixing pin and a rotor. The front end of the fixing pin and the rear end of the rotor are each provided with corresponding ratchet teeth, matching and cooperating with each other. The first slant face is disposed at a rear end of the fixing pin.

According to a further aspect of the present invention, a central rod is placed penetrating through the top rod and the ratchet mechanism.

According to yet another aspect of the present invention, the outer shell mentioned above is a circular sleeve, such that on the wall at the rear end of the circular sleeve is provided with round holes, for insertion and receiving of a push button, while the rear end of the inner sleeve is connected to a single direction valve and a filter net pad.

In operation of the single push button multi-function water output switching structure, after the push button is pressed, the slant face below the push button will push the fixing pin of the ratchet mechanism to move, and bring the rotor to rotate. The rotation of the rotor will bring the top rod into rotation, and that will push the top of the core plug at its front end through its end surface of shallow and deep. In this way, the core plug is made to open or close the connection and communication between the water output hole of the water output guiding sleeves and the water channel at its rear end, in achieving various different ways of water output through the open and close of various different core plugs. The multi-function faucet structure of ratchet mechanism having ratchet teeth has the following advantages: simple in structure, optimal in design, in achieving various different ways of water outputs through pressing a single push button.

Further scope of the applicability of the present invention will become apparent from the detailed descriptions given hereinafter. However, it should be understood that the detailed descriptions and specific examples, while indicating preferred embodiments of the present invention, are given by way of illustration only, since various changes and modifications within the spirit and scope of the present invention will become apparent to those skilled in the art from this detailed descriptions.

BRIEF DESCRIPTION OF THE DRAWINGS

The related drawings in connection with the detailed descriptions of the present invention to be made later are described briefly as follows, in which.

DETAILED DESCRIPTION OF THE PREFERRED EMBODIMENT

The purpose, construction, features, functions and advantages of the present invention can be appreciated and understood more thoroughly through the following detailed description with reference to the attached drawings.

Figure 1:
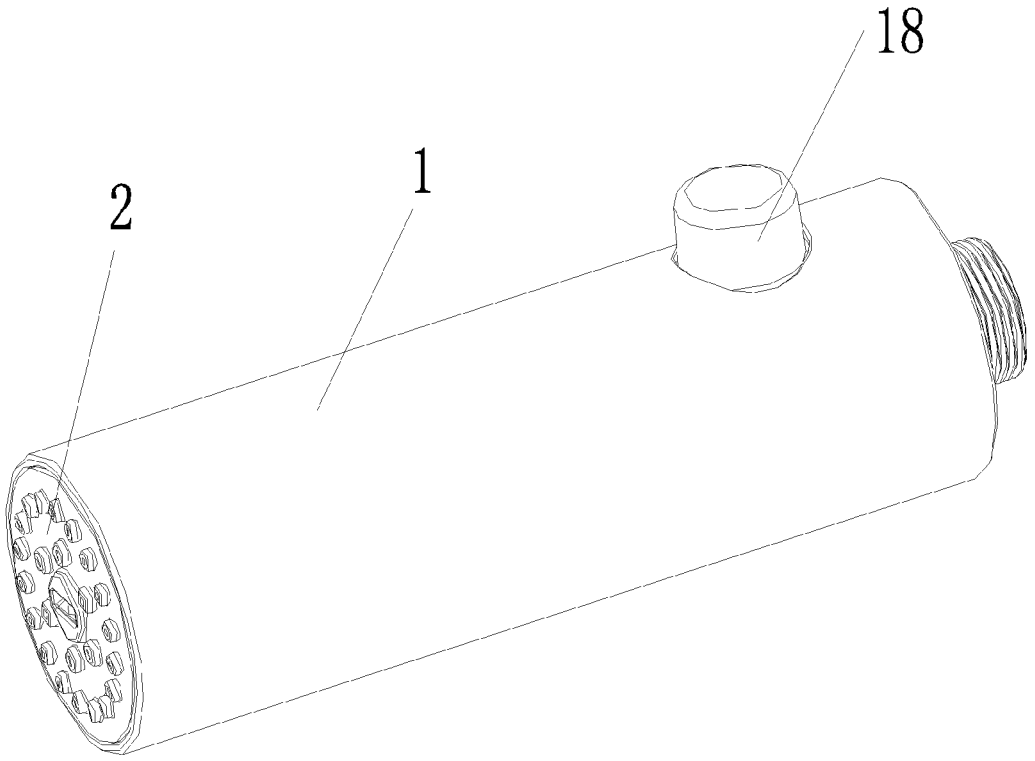
FIG. 1 is a schematic view of a single push button multi-function water output switching structure according to an embodiment of the present invention.
Figure 2:
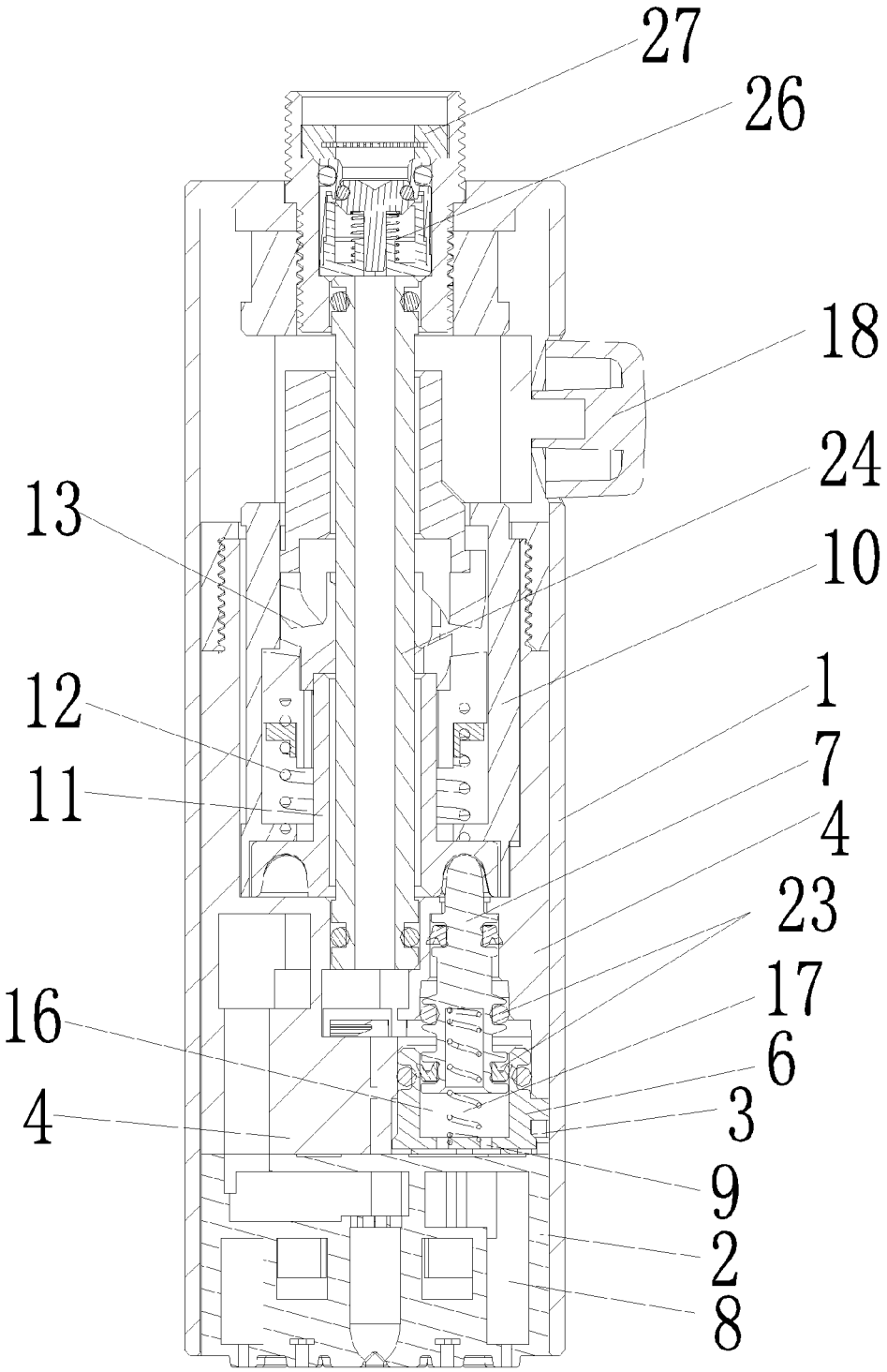
FIG. 2 is a cross section view of a single push button multi-function water output switching structure according to an embodiment of the present invention, when the core plug and the compression spring are in a normal state.
Figure 3:
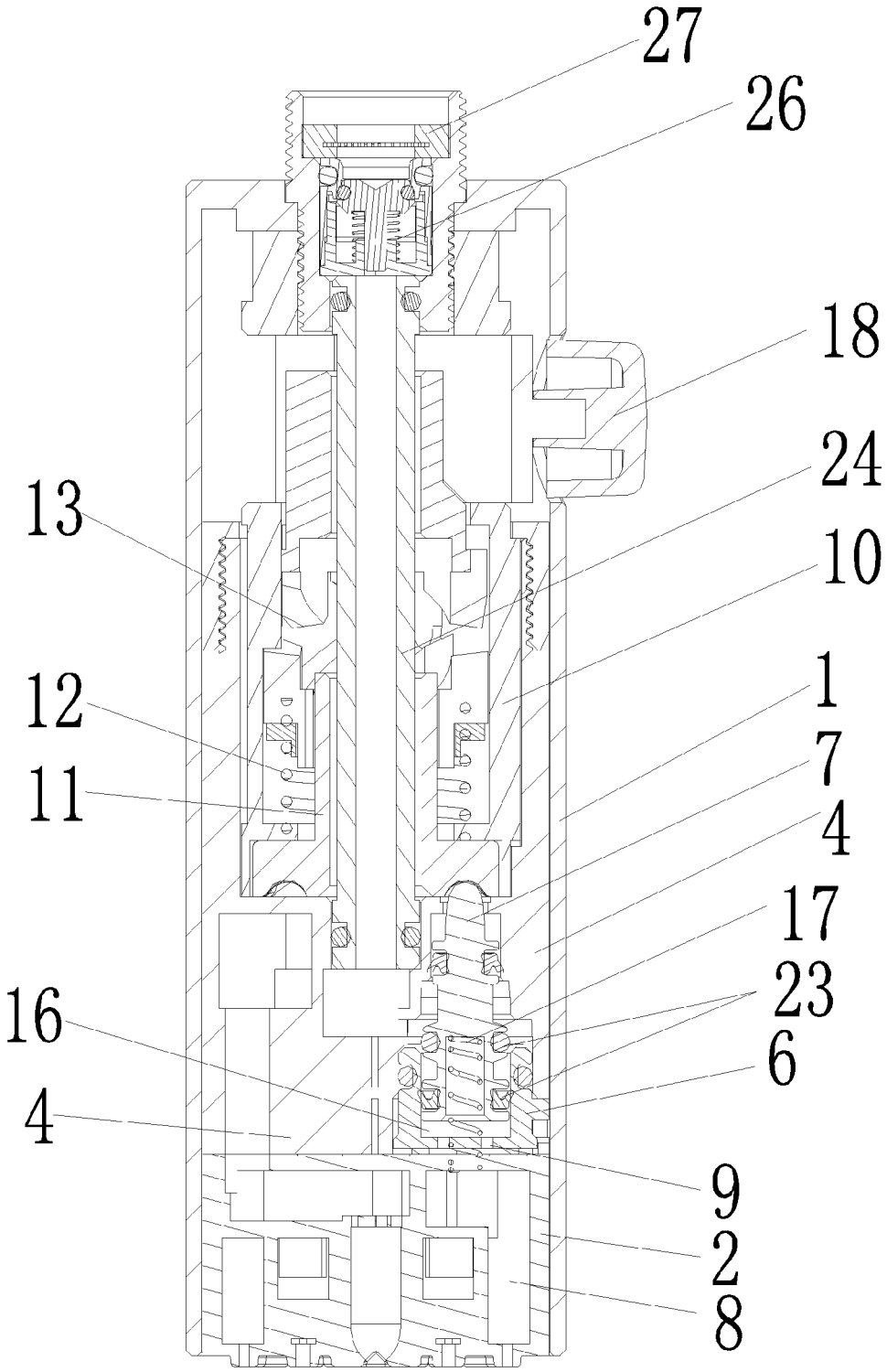
FIG. 3 is a cross section view of a single push button multi-function water output switching structure according to an embodiment of the present invention, when the core plug and the compression spring are in a compressed state.
Figure 4:
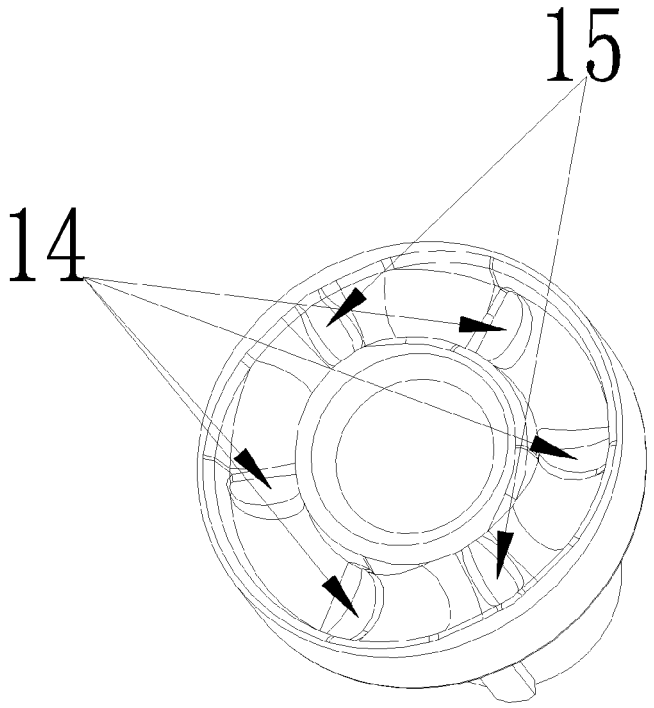
FIG. 4 is a perspective view of a top rod as viewed from an angle according to an embodiment of the present invention.
Figure 5:
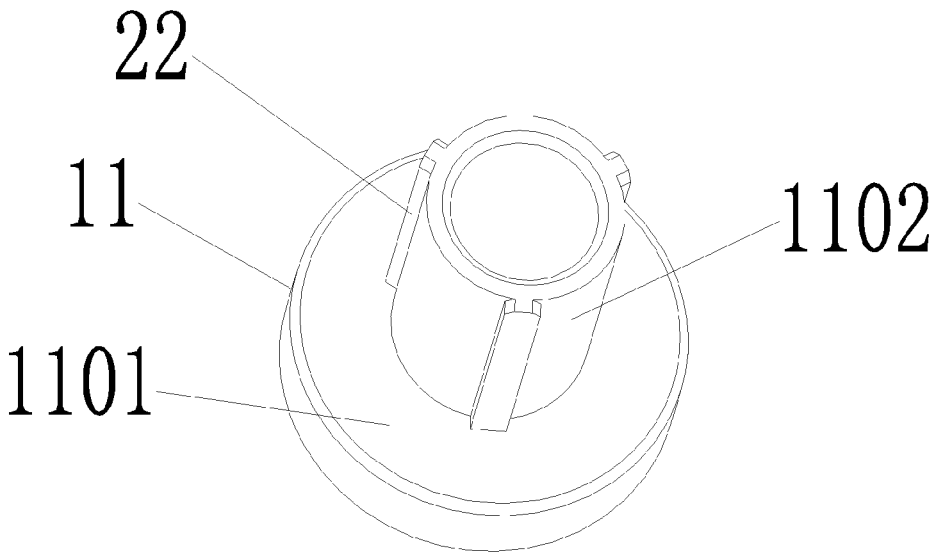
FIG. 5 is a perspective view of a top rod as viewed from another angle according to an embodiment of the present invention.
Figure 6:
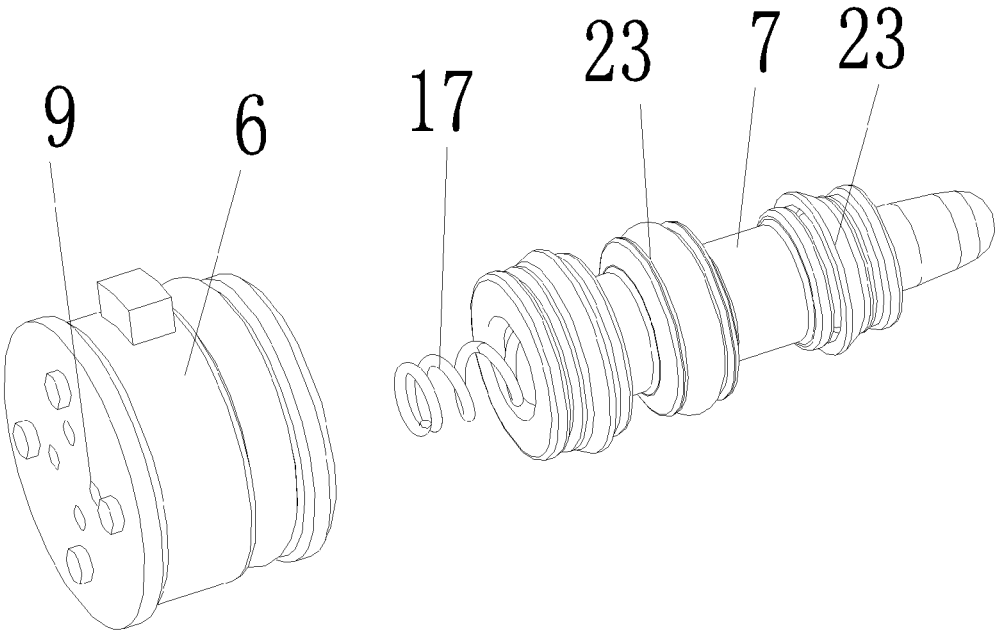
FIG. 6 is a perspective view of a water output guiding sleeve and core plug according to an embodiment of the present invention.
Figure 7:
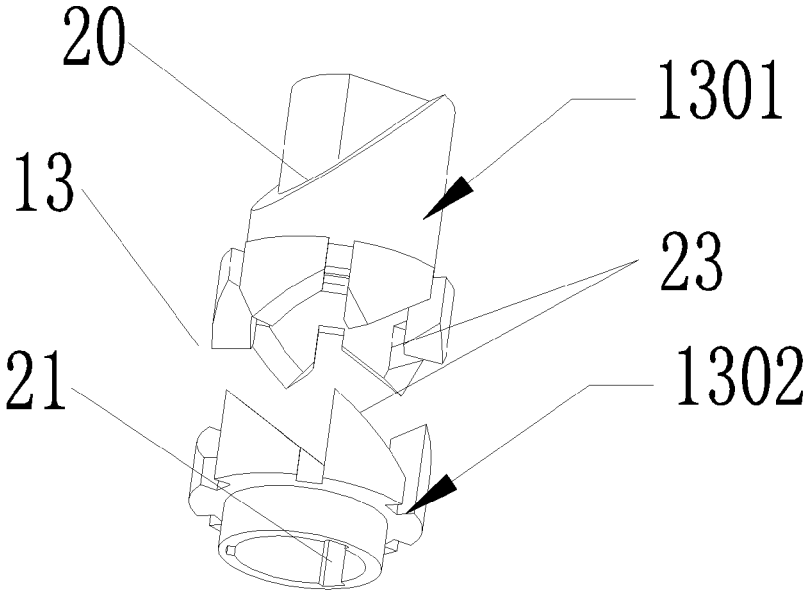
FIG. 7 is a perspective view of a ratchet mechanism according to an embodiment of the present invention.
Figure 8:
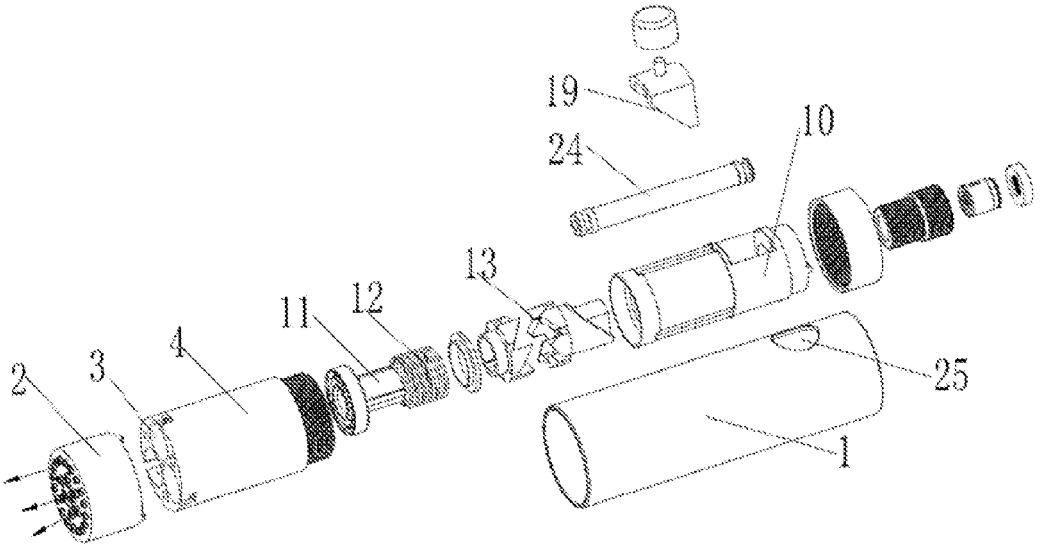
FIG. 8 is an exploded view of a single push button multi-function water output switching structure of FIG. 1 according to an embodiment of the present invention.

Refer to FIGS. 1 to 8 respectively for a schematic view of a single push button multi-function water output switching structure according to an embodiment of the present invention; a cross section view of a single push button multi-function water output switching structure according to an embodiment of the present invention, when the core plug and the compression spring are in a normal state; a cross section view of a single push button multi-function water output switching structure according to an embodiment of the present invention, when the core plug and the compression spring are in a compressed state; a perspective view of a top rod as viewed from an angle according to an embodiment of the present invention; a perspective view of a top rod as viewed from another angle according to an embodiment of the present invention; a perspective view of a water output guiding sleeve and core plug according to an embodiment of the present invention; a perspective view of a ratchet mechanism according to an embodiment of the present invention; and an exploded view of a single push button multi-function water output switching structure of FIG. 1 according to an embodiment of the present invention.

As shown in FIGS. 1 to 8, the present invention provides a single push button multi-function water output switching structure, including an outer shell 1, and a water output panel 2, a seat body 4, and an inner sleeve 10 disposed in sequence in the outer shell 1. Wherein, the seat body 4 is provided with three through hole channels 3, while inside the three through hole channels 3 are each provided with a set of water output guiding sleeves 6 and a core plug 7. The water output panel 2 is provided with three sets of independent water output channels 8, and a water output end surface of the water output guiding sleeve 6 is provided with a water output hole 9 corresponding to and in communication with the water output channels 8. An inner sleeve 10 is sleeved in a cavity in a rear portion of the seat body 4, and in the inner sleeve 10 is disposed in sequence a top rod 11 pressing a top of a core plug 7, a top press spring 12, and a ratchet mechanism 13. On an end surface of a top rod 11 is provided with a plurality of deep indent pits 14 and a plurality of shallow indent pits 15, such that a rear end of each core plug 7 is acted against in the deep indent pit 14 or the shallow indent pit 15. A compression spring 17 is provided between a front end of the core plug 7 and an indent cavity 16 at a rear end of the water output guiding sleeve 6, a push button 18 is each provided on the inner sleeve 10 and the outer shell 1. A slant face 19 at a lower end of the push button 18 works in cooperation with a first slant face 20 at a rear end of the ratchet mechanism 13, and on the top rod 11 is provided with a protrusion button 22 acting in cooperation with an inner wall button slot 21 at a movable end of the ratchet mechanism 13.

Further, in order to achieve tight seal, on the core plug 7 is provided with two seal rings 23, to work in tight seal cooperation with an inner wall of an indent cavity 16 at a rear end of the water output guiding sleeves 6.

Moreover, in order to achieve optimal design, the top rod 11 includes a top disk 1101, and a column rod 1102 disposed at the rear end of the top disk 1101, while a top press spring 12 is sleeved around the column rod 1102.

In addition, in order to achieve optimal design, the ratchet mechanism 13 includes a fixing pin 1301 and a rotor 1302. The front end of the fixing pin 1301 and the rear end of the rotor 1302 are each provided with corresponding ratchet teeth 23, matching and cooperating with each other. The first slant face 20 is disposed at a rear end of the fixing pin 1301.

Further, in order to guide the direction of the water flow, a central rod 24 is placed penetrating through the top rod 11 and the ratchet mechanism 13.

Moreover, the outer shell 1 mentioned above is a circular sleeve, such that on the wall at the rear end of the circular sleeve is provided with round holes 25, for insertion and receiving of a push button 18, while the rear end of the inner sleeve 10 is connected to a single direction valve 26 and a filter net pad 27.

In operation of the single push button multi-function water output switching structure, after the push button is pressed, the slant face below the push button will push the fixing pin 1301 of the ratchet mechanism 13 to move, and bring the rotor 1302 to rotate. The rotation of the rotor 1302 will bring the top rod 11 into rotation, and that will push the top of the core plug 7 at its front end through its end surface of shallow and deep. In this way, the core plug 7 is made to open or close the connection and communication between the water output hole of the water output guiding sleeves 6 and the water channel at its rear end, in achieving various different ways of water output through the open and close of various different core plugs 7.

Compared with the prior art, the advantages of the single push button multi-function water output switching structure are that: simple in structure, optimal in design, and is capable of achieving various different ways of water outputs through pressing a single push button.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. A single push button multi-function water output switching structure, comprising: an outer shell, and a water output panel, a seat body, and an inner sleeve disposed in the outer shell, wherein, the seat body is provided with three through hole channels, while inside the three through hole channels are each provided with a set of water output guiding sleeve and a core plug, the water output panel is provided with three sets of independent water output channels, and a water output end surface of the water output guiding sleeve is provided with a water output hole corresponding to and in communication with the water output channels, an inner sleeve is sleeved in a cavity in a rear portion of the seat body, and in the inner sleeve is disposed in sequence a top rod pressing a top of the core plug, a top press spring, and a ratchet mechanism, on an end surface of the top rod is provided with a plurality of deep indent pits and a plurality of shallow indent pits, such that a rear end of each core plug is acted against in the deep indent pit or the shallow indent pit, a compression spring is provided between a front end of the core plug and an indent cavity at a rear end of the water output guiding sleeve, a push button is each provided on the inner sleeve and the outer shell, a slant face at a lower end of the push button works in cooperation with a first slant face at a rear end of the ratchet mechanism, and on the top rod is provided with a protrusion button acting in cooperation with an inner wall button slot at a movable end of the ratchet mechanism.

2. The single push button multi-function water output switching structure as claimed in claim 1, wherein on the core plug is provided with two seal rings, to work in tight seal cooperation with an inner wall of an indent cavity at a rear end of the water output guiding sleeve.

3. The single push button multi-function water output switching structure as claimed in claim 1, wherein the top rod includes a top disk, and a column rod disposed at the rear end of the top disk, while a top press spring is sleeved around the column rod.

4. The single push button multi-function water output switching structure as claimed in claim 1, wherein the ratchet mechanism includes a fixing pin and a rotor, the front end of the fixing pin and the rear end of the rotor are each provided with corresponding ratchet teeth, matching and cooperating with each other, while the first slant face is disposed at the rear end of the fixing pin.

5. The single push button multi-function water output switching structure as claimed in claim 1, wherein a central rod is placed penetrating through the top rod and the ratchet mechanism.

6. The single push button multi-function water output switching structure as claimed in claim 1, wherein the outer shell is a circular sleeve, and on the wall at the rear end of the circular sleeve is provided with round holes, for insertion and receiving of the push buttons, while the rear end of the inner sleeve is connected to a single direction valve and a filter net pad.

* * * * *